US005089351A

United States Patent [19]

Baarns

[11] Patent Number: 5,089,351

[45] Date of Patent: Feb. 18, 1992

[54] PROCESS FOR CREATING ARTWORKS BY APPLICATION OF CRAYON AND INK

[76] Inventor: Antoinette W. Baarns, 1521 44th St., NW., Washington, D.C. 20007

[21] Appl. No.: 544,861

[22] Filed: Jun. 27, 1990

[51] Int. Cl.[5] ..... B05D 5/06; B41M 5/10

[52] U.S. Cl. ..... 428/488.1; 427/11; 427/262; 427/265; 427/267; 427/274; 427/280; 427/369; 427/371; 428/535

[58] Field of Search ..... 427/11, 282, 288, 259, 427/258, 261, 262, 265, 267, 274, 280, 369, 371; 428/486, 535, 488.1

[56] References Cited

U.S. PATENT DOCUMENTS

| | | | |
|---|---|---|---|
| Re. 17,654 | 4/1930 | Weber | 427/265 |
| 469,045 | 2/1892 | Laesecke | 427/262 |
| 901,824 | 10/1908 | Pidelaserra y Brias | 427/265 |
| 1,608,281 | 11/1926 | Weber | 427/265 |
| 1,627,214 | 5/1927 | Sutphen | 427/265 |
| 1,924,501 | 8/1933 | Kelly | 427/262 |
| 2,065,266 | 12/1936 | Connelly | 427/265 |
| 4,532,157 | 7/1985 | Schmidt et al. | 427/262 |

*Primary Examiner*—Janyce Bell
*Attorney, Agent, or Firm*—J. T. Martin

[57] ABSTRACT

A process for creating a work of art from a base medium, crayon and ink that comprises selecting a base medium that affords a surface to which crayon and ink can adhere, applying a crayon to the surface of said base medium, removing from the surface of said base medium any excess crumbs of crayon that failed to firmly adhere to the surface of said base medium, applying ink over the surface of the areas of crayon and the surface of the areas of the base medium that are free of crayon, removing substantially all the ink other than a thin film of ink from the surface of the areas of crayon and the surface of the areas of the base medium that are free of crayon before the ink is allowed to dry, allowing the thin film of ink to dry on the surface of the areas of crayon and the surface of the areas of base medium that are free of crayon, and rubbing the surface of the areas of crayon and the surface of the areas of the base medium that are free of crayon to remove a portion of the dried ink and produce a sheen to the work of art.

4 Claims, No Drawings

PROCESS FOR CREATING ARTWORKS BY APPLICATION OF CRAYON AND INK

I, Antoinette Wilhelmina Baarns, a citizen of Holland, residing at 1521 44th Street, N.W., Washington, D.C. 20007, have invented a process for creating artworks by the application of crayon and ink to a base medium. Although all the materials used in this process are well known in the art, I believe no one has conceived of combining those materials according to this process to produce a work of fine art.

In summary, my process for creating a work of art from a base medium, crayon and ink comprises selecting a base medium that affords a surface to which crayon and ink can adhere, applying a crayon to the surface of said base medium, removing from the surface of said base medium any excess crumbs of crayon that failed to firmly adhere to the surface of said base medium, applying ink over the surface of the areas of crayon and the surface of the areas of the base medium that are free of crayon, removing substantially all the ink other than a thin film of ink from the surface of the areas of crayon and the surface of the areas of the base medium that are free of crayon before the ink is allowed to dry, allowing the thin film of ink to dry on the surface of the areas of crayon and the surface of the areas of base medium that are free of crayon, and rubbing the surface of the areas of crayon and the surface of the areas of the base medium that are free of crayon to remove a portion of the dried ink and produce a sheen to the work of art.

The first material needed for this process is the base medium. The best base medium is watercolor art-paper, such as 140-pound, rough watercolor paper that is available from J. Perricot, Arches Special M.B.M. and is currently being sold as Veritable Papier D'Arches "Torchon" paper. Another art paper that has proven satisfactory is 140-pound, cold-press watercolor paper available from the Strathmore Paper Company, Westfield, MA 01085, that is currently being sold as "Gemini" mould-made, 100% cotton, watercolor paper. The second material needed for this process is at least one crayon. The best crayons are available from Binney & Smith, Inc., Easton, PA 18044-0431, and are currently being sold as "Crayola" crayons. The third material needed for this process is ink. The best ink is 17 Black India Drawing Ink A available from Pelikan AG, D-3000 Hanover 1, West Germany R.F.A. And the fourth material is water, which is optional. However, I have found that the best results have been obtained by using a small amount of water to dilute the ink before applying the ink during the process.

Proper tools should be used to combine these materials and work them together during the process steps to obtain the optimum results and achieve a work of fine art as the end product of this process. A means such as soft toilet paper is needed to remove the loose crumbs of crayon from the surface of the work before application of the ink to the work. I have found that the best soft paper for this purpose is available from Procter & Gamble, Cincinnati, Ohio 45202, and is currently being sold as "White Cloud" toilet paper. A means such as a soft brush is needed to apply the ink to the paper. I have found that the best brush for this purpose is a Number 6 Bamboo wash brush available from M. Grumbacher, Inc., Cranbury, NJ 08512. A means to wipe away excess ink is needed, and I have found that an ordinary soft cotton rag is satisfactory for that purpose. Also, a means such as a pre-washed, rough terry-cloth towel is needed to work the ink into the paper while at the same time removing excess ink from the surface of the work. I have found that the best towel means is an ordinary 100%-cotton bath towel available from Fieldcrest Mills, Inc., New York, N.Y. 10018 that has been washed several times to remove all traces of starch and lint from the towel.

The first step in my process is to select the desired base medium, such as paper, and lay it flat on a hard surface. An outline of the drawing may be applied to the paper before this step, but an outline is not necessary. Select a desired color of crayon and begin to rub the crayon into the surface of the paper using a back-and-forth motion to cover an area of the paper surface with that color. It should be noted that the crayon should be applied to the paper at ordinary room temperature so that it is neither too hard nor too soft. The desired result of such application is the appearance of stippling, in which small portions of the area covered are solid crayon and intermittant small portions of the area covered are free of crayon. This desired appearance is similar to the appearance obtained by Georges Seurat in his paintings "Evening, Honfleur" and "Porten-Bessin" shown on pages 89 and 111, respectively, of the art book entitled Seurat by Pierre Courthion published by Harry N. Abrams, Inc., New York, Library of Congress Catalog Card Number 87-73460, ISBN 0-8109-1519-7. If multiple colors are desired, select additional colors of crayons and repeat the step for each color desired. Any color of crayon can be used, but I have found that the primary and secondary colors create the most pleasing visual appearance.

After each color of crayon selected is applied to the paper, the excess crayon that does not firmly adhere to the paper may be removed by wiping over the area covered by crayon with small wads of "White Cloud" toilet paper. The toilet paper used needs to be sufficiently soft and have a surface texture that enables it to pick up the loose crumbs of crayon and remove them from the paper surface without smearing them into the small portions of the area covered by the crayon that are free of crayon. Such removal of the remaining loose crumbs of crayon may be accomplished after application of each color of crayon to the paper, or may be accomplished after application of all the colors of crayon to the paper, as desired by the artist.

The next step in my process involves applying the ink to the combination of crayon applied onto the paper. The best results have been obtained by pouring the Pelikan ink into a bowl and adding approximately five to eight drops of water to each tablespoon of ink. Take a wash brush, dip it in the diluted ink, and brush a portion of the crayon-on-paper work with the diluted ink. I have found that the most pleasing visual impression can be obtained by applying the diluted ink to both the surface of the crayon that adheres to the paper and to every area of the surface of the paper that has been left free of crayon. Such consistancy of filling every area of the surface of the paper that has been left free of crayon with black ink is not necessary to the process, but is a matter of artistic preference.

If the drawing is relatively large, such as 22" by 30", and nearly covered by crayon, brush the diluted ink over approximately one third of the work and immediately wipe away the excess ink with a clean portion of a cotton rag, leaving a thin film of diluted ink over the portion of the crayon-on-paper work brushed with the diluted ink. As soon as the excess ink has been removed, brush the ink over a second third of the work and immediately wipe away the excess ink with another clean portion of the cotton rag. As soon as the excess ink has been removed, brush the ink over the third portion of the work and immediately wipe away the excess ink with another clean portion of the cotton rag. Allow the ink that remains on the crayon covered paper to dry for approximately two minutes, making sure that no more than the thin film of diluted ink dries on the surface of the crayon.

As soon as the approximately two minutes of drying time have lapsed, take the pre-washed, rough terry-cloth towel and wrap a small portion of the clean towel around two or three of the fingers of one hand and begin to rub the surface of the work with the towel, using enough pressure to remove most of the dried ink, but not enough pressure to crush the crayon that has been applied to the paper. I have found that rubbing by a back-and-forth motion produces the best results, although the rubbing motion chosen is a matter of artistic preference. As soon as the desired portion of the dried ink has been removed from a small portion of the work, wrap another clean small portion of the towel around the fingers, and rub away the desired portion of the dried ink from another small portion of the work. Continue using clean small portions of the towel to remove the desired amounts of dried ink from successive small portions of the work until all the dried ink that the artist desires to remove from the work has been removed. During this removal process, the rubbing pressure used to remove the desired portion of the dried ink from the work also polishes the surface of the crayon applied to the paper, causing the work to develop a sheen. The relative portion of the dried ink that is removed during this process step, and the degree of shine or sheen applied to the finished work are matters of artistic preference. I have found that the sheen can be enhanced by a final light rubbing in a circular motion in the same way that one would wax an automobile.

By following these process steps, an artist will create a work of fine art whose value will depend on many factors, including the subject matter chosen, the skill in drawing the forms depicted by the work, and the choice of colors used to depict the subject matter. However, regardless of the relative value of each work created using this process, the texture of the work obtained by using this process can add a pleasing visual effect to any work of art created by applying crayon and ink to a suitable base medium.

I claim:

1. A process for creating a work of art from a base medium, crayon and ink that comprises (a) selecting a base medium that affords a surface to which crayon and ink can adhere, (b) applying at least one crayon to the surface of said base medium with sufficient pressure to cause a portion of the crayon to adhere to the surface of said base medium to produce the appearance of stippling from areas of crayon and areas free of crayon, (c) removing from the surface of said base medium any excess crumbs of crayon that failed to firmly adhere to the surface of said base medium, (d) applying ink over the surface of the areas of crayon and at least a portion of the surface of the areas of the base medium that are free of crayon, (e) removing substantially all the ink other than a thin film of ink from the surface of the areas of crayon and surface of the areas of the base medium that are free of crayon before the ink is allowed to dry, (f) allowing the thin film of ink to dry on the surface of the areas of crayon and the surface of the areas of base medium that are free of crayon, and (g) rubbing the surface of the areas of crayon and the surface of the areas of the base medium that are free of crayon to remove a portion of the dried ink and produce a sheen to the work of art.

2. A process for creating a work of art from a base medium, crayon and ink as defined in claim 1 in which the ink is applied over the surface of the areas of crayon and the entire surface of the areas of the base medium that are free of crayon.

3. A work of art created by the process defined in claim 1.

4. A work of art created by the process defined in claim 1 in which the ink is applied over the surface of the areas of crayon and over the entire surface of the areas of the base medium that are free of crayon.

* * * * *